US007268651B2

(12) United States Patent
Eckert et al.

(10) Patent No.: US 7,268,651 B2
(45) Date of Patent: Sep. 11, 2007

(54) ELECTROMECHANICAL SWITCHING DEVICE

(75) Inventors: Gunther Eckert, Maxhütte-Haidhof (DE); Wolfgang Leitl, Wenzenbach (DE)

(73) Assignee: Siemens Aktiengesellschaft, Munich (DE)

( * ) Notice: Subject to any disclaimer, the term of this patent is extended or adjusted under 35 U.S.C. 154(b) by 50 days.

(21) Appl. No.: 10/554,165

(22) PCT Filed: Apr. 2, 2004

(86) PCT No.: PCT/EP2004/003536

§ 371 (c)(1),
(2), (4) Date: Oct. 21, 2005

(87) PCT Pub. No.: WO2004/097878

PCT Pub. Date: Nov. 11, 2004

(65) Prior Publication Data

US 2006/0214752 A1 Sep. 28, 2006

(30) Foreign Application Priority Data

Apr. 30, 2003 (EP) ..... 03009941

(51) Int. Cl.
*H01H 75/00* (2006.01)
*H01H 13/04* (2006.01)

(52) U.S. Cl. ..... 335/6; 335/8; 335/11; 335/159; 335/162; 335/202; 200/303

(58) Field of Classification Search ..... 335/6, 335/8–11, 159–163, 202; 200/303
See application file for complete search history.

(56) References Cited

U.S. PATENT DOCUMENTS 4,114,122 A * 9/1978 Grenier ..... 335/8

FOREIGN PATENT DOCUMENTS

| | | |
|---|---|---|
| DE | 32 42 062 C2 | 5/1984 |
| EP | 0 042 776 A1 | 12/1981 |
| EP | 0 403 358 A1 | 12/1990 |
| EP | 0 505 292 A1 | 9/1992 |

* cited by examiner

*Primary Examiner*—Ramon M. Barrera

(57) ABSTRACT

The invention relates to a electromechanical switching device having two movable contact elements interacting with a fixed contact. Said switching device has a housing. When viewing a fixing side from the top, said housing is divided into two areas bordering with a longitudinal side of the housing, one of the movable contact elements and the corresponding fixed contact being located in said areas, wherein each of the housing areas has a narrow partial area and a broad partial area bordering therewith. The broad partial area of the first housing area is adjacent to the narrow partial area of the second housing area and the narrow partial area of the first housing area is adjacent to the broad partial area of the second housing area. The actuation directions of the movable contact elements are directed opposite each other.

19 Claims, 5 Drawing Sheets

ELECTROMECHANICAL SWITCHING DEVICE

CROSS REFERENCE TO RELATED APPLICATIONS

This application is the US National Stage of International Application No. PCT/EP2004/003536, filed Apr. 2, 2004 and claims the benefit thereof. The International Application claims the benefits of European application No. 03009941.0, filed Apr. 30, 2003, both applications are incorporated by reference herein in their entirety.

FIELD OF INVENTION

The invention relates to a electromechanical switching device, especially an electromagnetic switching device, having at least two movable contact elements interacting with a fixed contact, which are arranged in adjacent areas of a housing subdivided into a number of areas.

SUMMARY OF THE INVENTION

An electromagnetic switching device with a divided housing, in which subareas each switch one current track, is for example known from DE 32 42 062 C2. Electromagnetic actuators as well as a thermal actuator are arranged in a first part of the housing featuring a first contact point. A second contact point and a further electromagnetic actuator are arranged in the second part of the housing. In addition there is an arc splitter chamber in each part of the housing. The switching mechanisms in the two parts of the housing are coupled. There is no provision for a thermal actuator, i.e. one that responds after a delay, in the second part of the housing.

Whereas the dividing surface between the two areas of the housing in the switching device known from DE 32 42 062 C2 runs in parallel to one fixing side of the housing, such a dividing surface within a housing of a switching device can for example also run perpendicular to the fixing plane in other embodiments. In each case, where there is provision for installing a larger number of individual components compared to a switching device with an undivided housing of the corresponding size, the result is restricted fitting space which typically requires the manufacturing of relatively expensive to manufacture and/or to install special components, for example coils with non-round cross sections.

A circuit arrangement with two housing parts is known from EP 0505 292 A1, in which a central dividing wall features an offset in a small central section in order in this way to create space in one of the housing parts for a thermal bimetallic element.

The object of the invention is to specify an electromechanical, especially an electromagnetic switching device with at least two movable contacts as well as fixed contacts interacting with these, which with a rational construction features an especially compact housing subdivided into a number of areas.

In accordance with the invention this object is achieved by the claims. In this case two movable contacts as well as fixed contacts interacting with these are arranged in a housing which is essential divided along an imaginary dividing surface which is perpendicular to a fixing side of the housing. By contrast with conventional multipart housings however the dividing surface within the housing preferably features a side offset, in approximately the center of the housing, so that each of the two parts of the housing feature a broader area and a narrower area adjoining it. In this case the narrow area of the second housing part adjoins the broad area of the first housing part and vice versa.

The mounting position of the two circuit arrangements comprising a movable contact and a fixed contact in the housing in each case can be characterized by the direction of operation of the relevant movable contact, in which said contact meets its assigned fixed contact or fixed contacts during the switching process. Preferably the actuation directions of the movable contacts are in opposite directions to one another. This enables circuit arrangements which do not have a uniform width all the way along to be accommodated in the housing in an especially space-saving way, said arrangements for example being narrower in an area adjoining the fixed contact than in an area adjoining the movable contact. Opposing actuation directions of the movable contacts are not taken exclusively to mean cases in which the angle between the actuation directions amounts to exactly 180°, but also cases in which the angle has any other value of more than 90°. Alternatively however embodiments are also implemented in which the directions of actuation of the movable contacts are at least approximately the same.

Preferably the two housing areas are identically formed, but are mirrored around a geometrical vertical axis in the housing, i.e. in each plane they are thus centrosymmetric in relation to the geometrical vertical axis.

Especially suitable is the design of the housing for a switching device which contains two actuators with an immediate response, especially electromagnetic actuators, as well as two actuators with a delayed response, especially thermal actuators. Preferably this type of switching device is employed as a circuit breaker.

Thus, in this preferred embodiment an electromechanical switching device with two actuators which respond immediately and two actuators with a delayed response, with a housing with one fixing side and longitudinal housing sides arranged perpendicular to this is produced, whereby in a first area of the housing adjoining the first longitudinal side of the housing the first actuator which responds immediately of the first transverse housing side faces the first actuator which responds after a delay of the second transverse housing side and in a second housing areas adjoining the second longitudinal housing side the second actuator which responds after a delay of the first transverse housing side faces the second actuator which responds immediately of the second transverse housing side.

Typically the minimum width of a circuit breaker is determined by the dimensions of the electromagnetic actuator as well as an arc splitter chamber where necessary. To accommodate a number of electromagnetic actuators within a standardized housing of a series device, especially with a width of 18 mm, some of the coils used in the prior art employed a cross section which deviated from the circular form. The manufacture of such coils, especially with a long, almost rectangular cross-section, is however relatively expensive compared to the manufacture of coils with a circular cross-section. In addition coils with a circular cross-section are as a rule better as regards their energy efficiency. The inventive arrangement of the actuators in the switching device allows simple use of actuators manufactured using conventional round coils, which each have a width of at least, preferably more than, half the total width of the housing. The same also applies to the arc splitter chambers arranged for each contact point.

An especially compact design of the housing can advantageously be achieved by the directions of actuation of the striker pins in the coils of the actuators being opposed to each other. The directions of actuation of the striker pins are in this case identical to the directions of actuation of the assigned movable contacts, preferably at least almost identical. In this way it is possible for the coil of one actuator in the housing to be adjacent to the striker pin of the other actuator in each case, which is very small by comparison with it. By comparison with the electromagnetic actuators the delayed actuators, which are also preferably embodied as bimetal strip actuators are relatively narrow.

Relative to an axis disposed normally to the housing fixing side the circuit arrangement of second immediate-response and second delayed-response actuator is essentially rotated through 180° relative to the circuit arrangement of first immediate-response and second delayed-response actuator. The particular advantage of the restricted or opposite arrangement of the individual actuators in the housing lies in the fact that even if each of the two circuit arrangements does not feature both an immediate-response and a delayed-response actuator, the individual components generating heat, especially coil and bimetal elements, are distributed evenly over the housing which is compact overall. Furthermore only small amounts of heat are produced because of the short current paths in the switching device.

A number of exemplary embodiments of the invention are explained in greater detail below on the basis of a drawing.

BRIEF DESCRIPTION OF THE DRAWINGS

Parts which correspond to each other or operate in the same way are shown by the same reference symbols in all the Figures.

DETAILED DESCRIPTION OF INVENTION

Figure 1A:
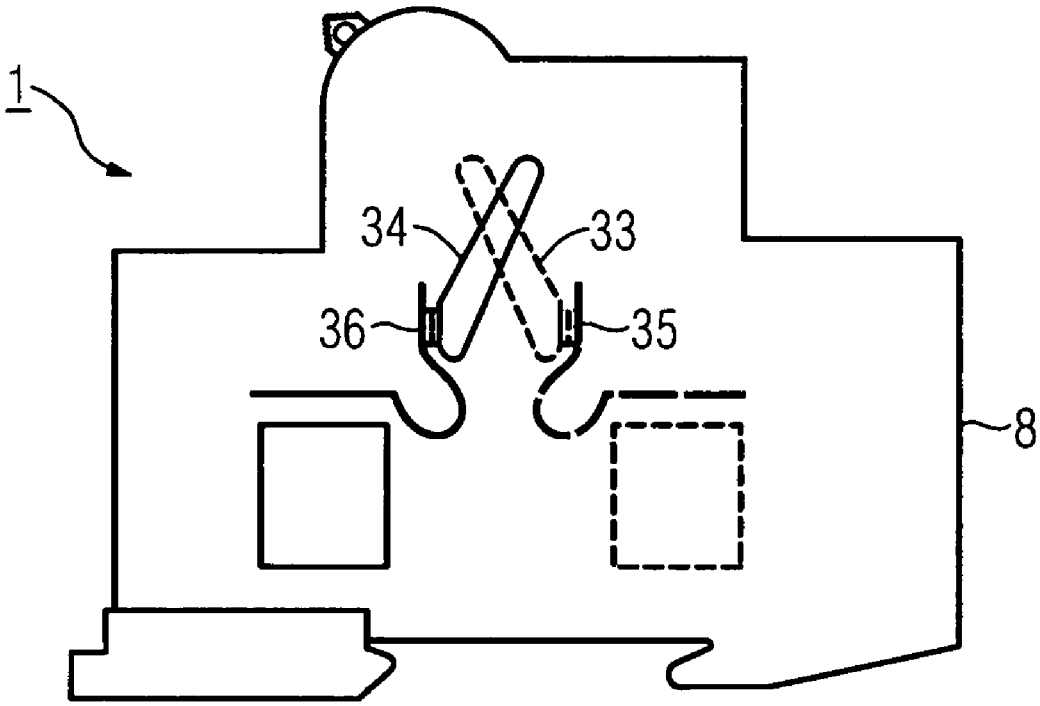
FIGS. 1*a* and *b* show in symbolic cross-sectional diagrams an electromechanical switching device with two movable contacts able to be actuated in opposite directions, FIGS. 2*a* and *b* show a schematic diagram of the division of a switching device into a number of housing areas in each case, FIGS. 3*a* and *b* show greatly simplified cross-sectional diagrams of a switching device with a housing divided up lengthwise, FIGS. 4*a* and *b* show an incomplete perspective diagram of a circuit breaker as an electromechanical switching device with a housing shell or an indicated housing.
Figure 1B:
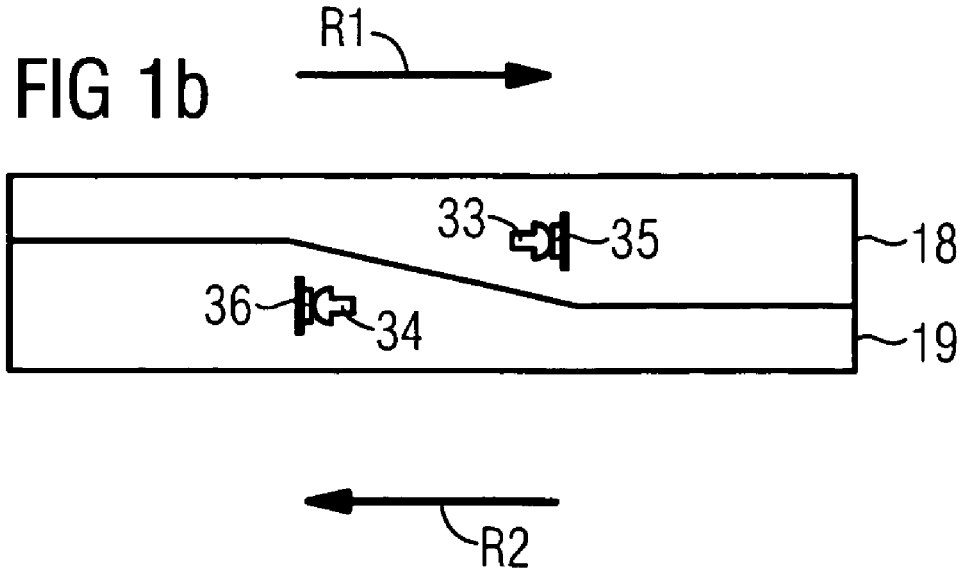

FIGS. 1*a* and 1*b* show symbolically in lengthwise section or cross section an electromechanical switching device 1 as a series built-in device in which two current paths are switched. To this end switching device 1 features a housing 8, which is subdivided lengthwise into a first housing area 18 and a second housing area 19. In each of the housing areas 18,19, for switching a current path there is a movable contact element 33,34 and a fixed contact 35,36 which interacts with it in each case. The first movable contact 33 arranged in the first housing area 18 is movable in a direction of actuation R1 in the direction of the assigned first fixed contact 35, while the second movable contact 34 in the second housing area 19 is movable in the opposite direction of actuation R2 to close the corresponding current path to the second fixed contact 36. The movable contacts 33,34 are for example able to be actuated manually or electromagnetically. As regards further possible details of the switching device 1 the reader is referred to the description given for FIGS. 4*a* to 6*b*.

Figure 2A:
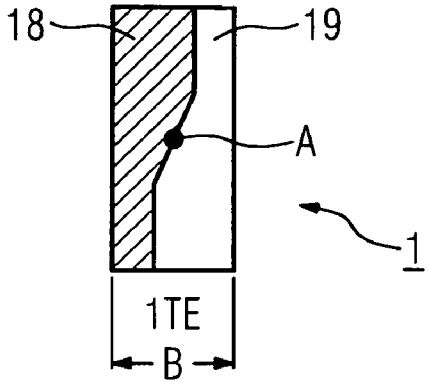
Figure 2B:
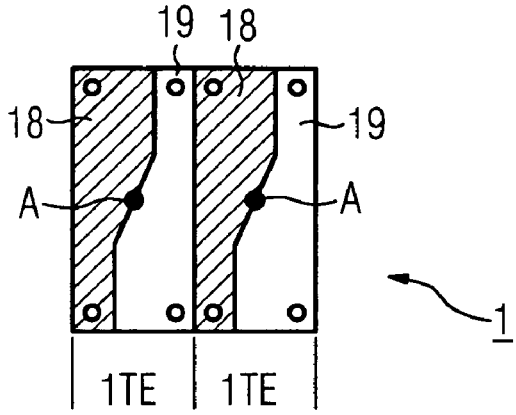

FIGS. 2*a* and 2*b* show different variants of the cross section of the design of a switching device 1. In the exemplary embodiment according to FIG. 2*a* the two housing areas 18,19 are formed in an identical way but are mirrored around a geometrical vertical axis A in the housing 8. The width B of the housing 8 is 18 mm, also referred to as one pitch unit (TE). The housing 8 according to FIG. 2*b* by contrast has a width of two pitch units (TE). In this case the individual housing areas 18,19 are each present twice in the housing 8. The form of a housing area 19 is created in each case by rotating an adjacent housing area 18 by 180°.

Figure 3A:
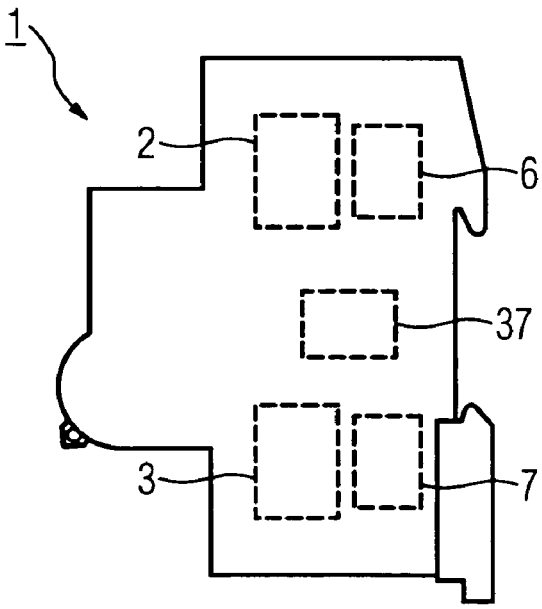
Figure 3B:
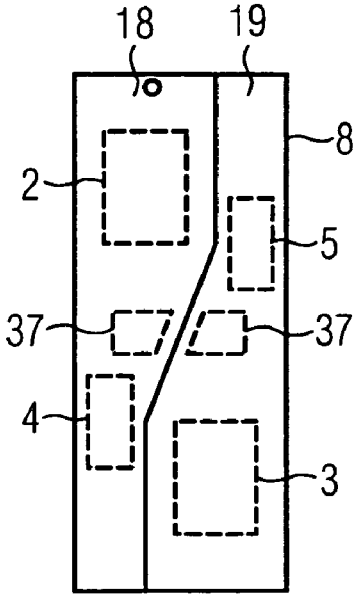
Figure 4B:
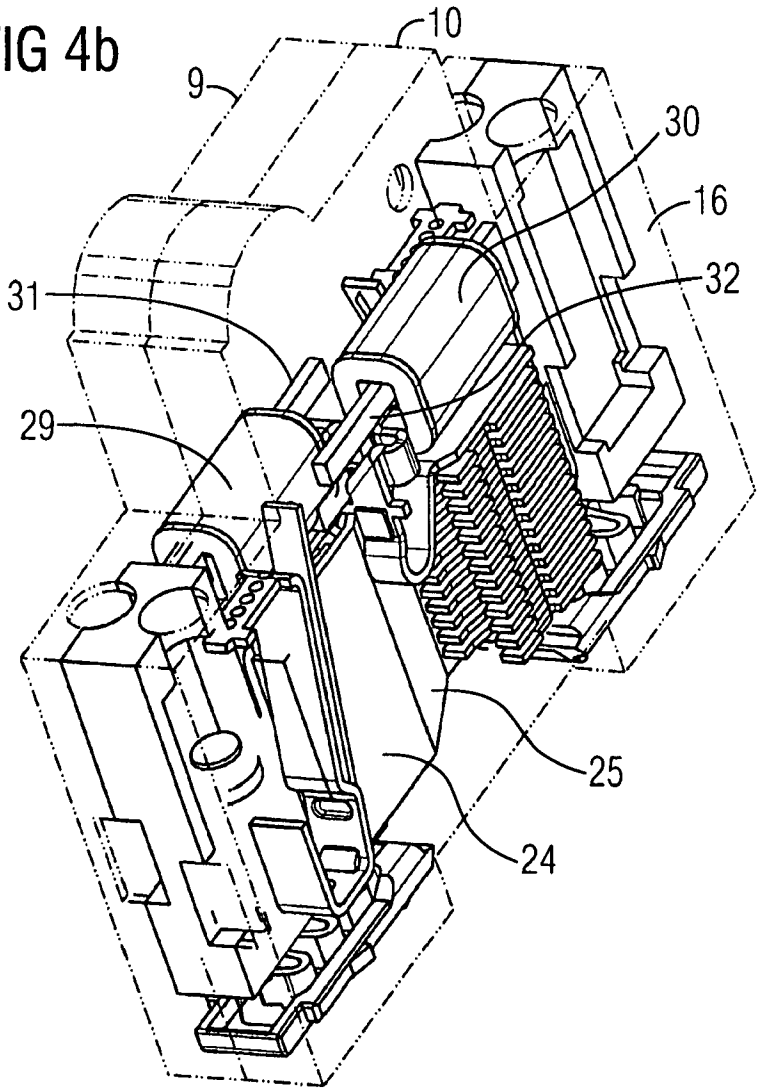
Figure 4A:
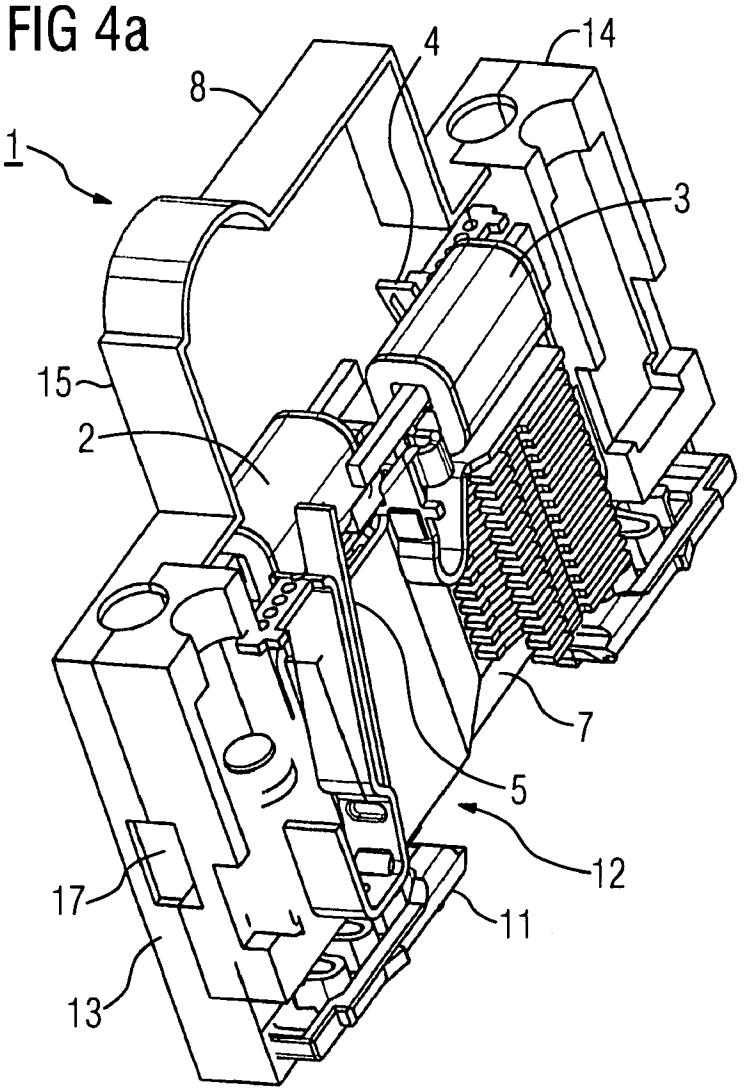
Figure 5:
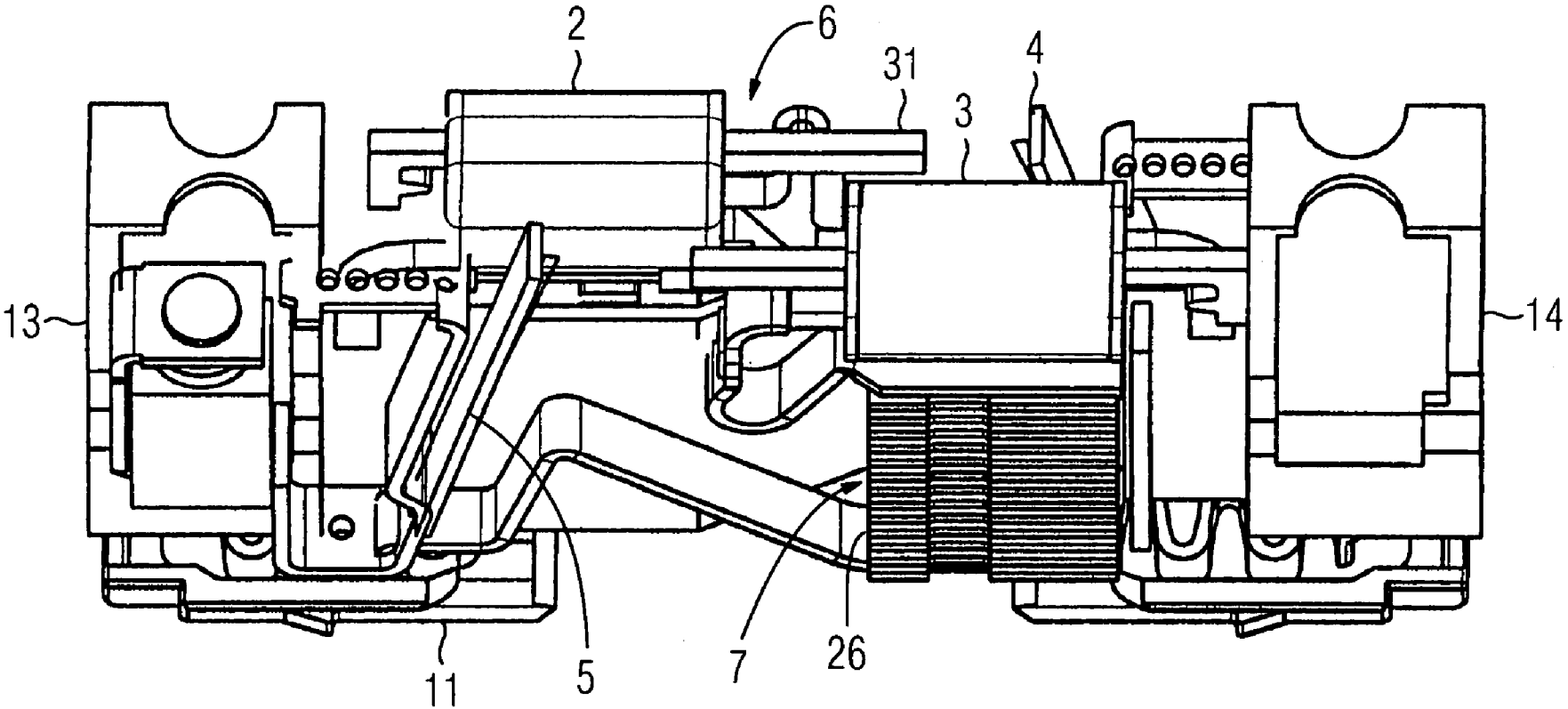
FIG. 5 shows a perspective diagram of a part of the switching device according to FIGS. 4*a* and 4*b*, and FIGS. 6*a* and *b* show a cross-sectional diagram of a switching device according to FIGS. 4*a* and 4*b* in each case.
Figure 6A:
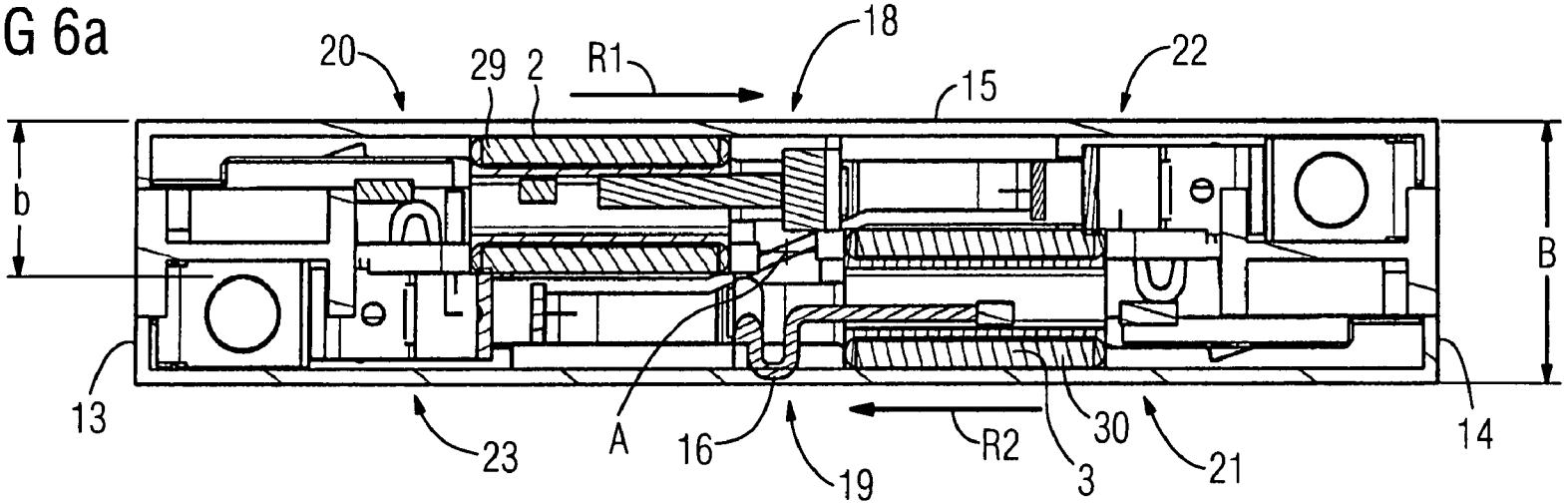
Figure 6B:
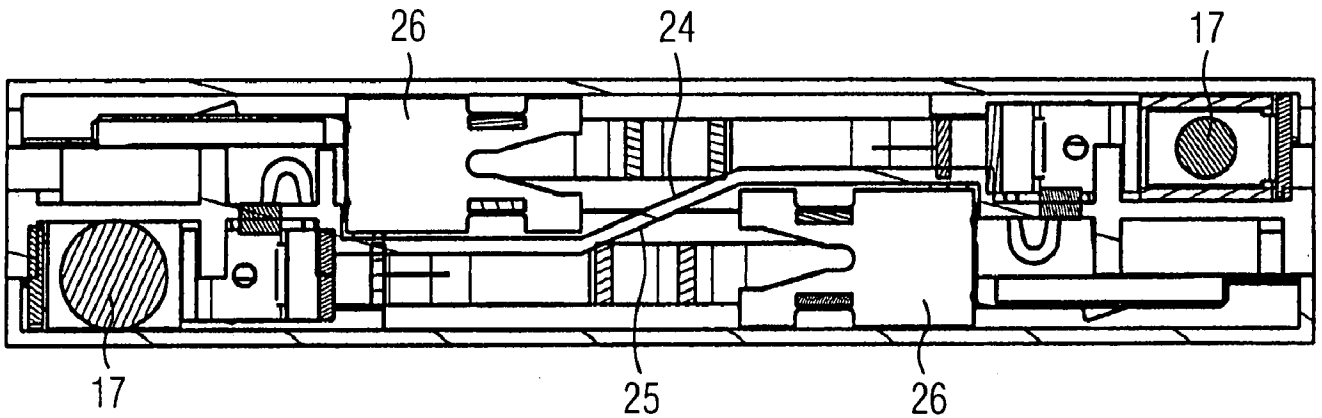

FIGS. 3*a* and 3*b* show a symbolic circuit breaker as switching device 1. An immediate-release actuator 2, 3 and a delayed-release actuator 4, 5 are arranged in the housing area 18,19 in each case. A compartment 37 is shown between the two actuators. Furthermore there is an arc splitter chamber 6, 7 in each of the two housing areas 18,19. The layout and the function of the mirrored circuit arrangements, each with an immediate-release actuator 2,3 and a delayed-release actuator 4,5 are identical. The switching device 1 with this layout is also referred to as a 1+1 device. The pairs of contacts each with one movable contact 33,34 and one fixed contact 35,36 are not shown in FIGS. 3*a* and 3*b*.

The circuit arrangements in the housing areas 18,19 are not necessarily identical. If for example in one of the housing areas 18,19 there is only one pair of contacts, but not a delayed or immediate actuator, nor a splitter system, the switching device is referred to as a 1+N switch. The stated components, namely an immediate-release actuator 2,3, a delayed-release actuator 4,5, an arc splitter chamber 6,7, as well as a pair of contacts comprising a movable contact 33,34 and a fixed contact 35,36 in one of the housing areas 18,19, and only one pair of contacts in the other housing area 18,19, are for example also contained in a so-called LS+HS switch, meaning a combination of circuit breaker and auxiliary circuit switch.

If the two housing areas 18,19 each contain exclusively one pair of contacts, but none of the previously-mentioned other components are present, this switch is a built-in (EBS) switch. Furthermore there is the option for example of combining the components of a circuit breaker 1 within one of the housing areas 18,19, as shown in FIG. 3*b*, with just one pair of contacts and a delayed-release actuator 4,5 in the second housing area 18,19, i.e. of not providing an immediate-release actuator and an splitter system in one of the housing areas 19. Further combinations within a switching device 1 are also implemented, depending on specific requirements.

FIGS. 4*a* to 6*b* show detailed diagrams of an exemplary embodiment of a circuit breaker 1 as an electromechanical switching device with two electromagnetic actuators 2,3, thermal actuators 4,5 and arc splitter chambers 6,7 in each case. A switching mechanism interacting with the actuators 2,3,4,5 is not shown for reasons of clarity. A housing 8 of the switching device 1 is composed of two housing halves 9,10 and has a width B. On a fixing side 11 the housing 8 features a cutout 12 which allows it to be attached to a support bar known as a top-hat bar in the known way. The sides of the housing perpendicular to the fixing side 11 are referred to as the transverse sides 13,14 and lengthwise sides 15,16. Two terminals 17 in each case are accessible from the transverse sides 13,14. Thus two current paths exist in each case, from a terminal 17 of the first transverse housing side 13 to a terminal 17 of the second transverse housing side 14. The current paths lead through one housing area 18,19 in each case, which is delimited by the first lengthwise housing side 15 or the second lengthwise housing side 16. Each of the housing areas 18,19 features a broad partial housing area 20,21 and a narrow partial housing area 22, 23, whereby the broad partial housing area 20 of the first housing area 18 adjoins the narrow partial housing area 23 of the second housing area 19 and the broad partial housing area 21 of the second housing area 19 adjoins the narrow partial housing area 22 of the first housing area 18. Between the housing areas 18,19 a dividing wall 24 can be seen which features an angled section 25 which defined the transition from the broad partial housing areas 20,21 to the narrow partial housing areas 22,23.

In the broad partial housing areas 20,21 a number of deionizing plates 26 of an arch splitter chamber 6,7 in each case are located between the electromagnetic or immediate-release actuator 2,3 and fixing side 11.

Through the middle of the angled section 25 of the dividing wall 24 runs an imaginary vertical axis A, which is arranged as a normal axis to the fixing side 11 and intersects any mounting rail present approximately in the middle. The electromagnetic actuators 2,3 as well as the thermal or delayed-release actuators 4,5 and the arc splitter chambers 6,7 are each arranged at least approximately symmetrically to vertical axis A. The same applies to the contact pieces—not shown—arranged between an electromagnetic actuator 2,3 and an associated thermal actuator 4,5 in each case, especially the movable contacts. The electromagnetic actuators 2,3 each feature a coil 29,30, within which a striker pin 31,32 is guided, for which the direction of actuation is specified by R1 or R2. Part of each pin 31,32 is adjacent to the coil 30,29 of the other electromagnetic actuators 3,2 in each case and is provided for actuating a latching mechanism not shown with which the thermal actuators 4,5 also interact.

Each of the coils 29,30 has a width b which is also equivalent overall to the width of the electromagnetic actuators 2,3, and, as can be especially seen from FIGS. 3*a* and 3*b*, is greater than half of the width B of the housing 8. The width B preferably amounts to 18 mm, also referred to as a unit of pitch with standard series built-in devices. Within this pitch unit one phase conductor and one neutral conductor or two phase conductors can be switched within the switching device 1 for example. The almost even distribution of components which generate heat, especially the actuators 2,3,4,5 within the housing 8 means that despite its compact dimensions, the housing guarantees a high switching capability. Likewise the space for the arc splitter chamber 6,7 is very well utilized. Furthermore there is no mutual magnetic influence between coils 29, 30, which are spaced far apart by comparison with coils arranged alongside each other. The coils 29,30 are rationally manufactured with circular wire.

The invention claim is:

1. An electromechanical switching device, comprising:

two fixed contacts, two movable contact elements each configured to interact with the fixed contacts; and a housing comprising a mounting side, wherein the housing viewed from above the mounting side is subdivided into first and second housing areas each adjoining a lengthwise side of the housing, wherein one of the movable contact elements and the associated fixed contact are located in each housing area, each housing area having a narrow partial housing area and an adjoining broad partial housing area, wherein the broad partial housing area of the first housing area is arranged adjacent to the narrow partial housing area of the second housing area, and the narrow partial housing area of the first housing area is arranged adjacent to the broad partial housing area of the second housing area, wherein the two movable contact elements are arranged and configured to be respectively actuated by a first actuation force and a second actuation force, the first and second actuation forces having opposing directions.

2. The switching device in accordance with claim 1, wherein the two housing areas are formed in an identical way but are mirrored around a geometrical vertical axis in the housing.

3. The switching device in accordance with claim 1, wherein at least one housing area contains an immediate-release actuator.

4. The switching device in accordance with claim 2, wherein at least one housing area contains an immediate-release actuator.

5. The switching device in accordance with claim 3, wherein a width of the immediate-release actuator is at least as large as half of a width of the housing.

6. The switching device in accordance with claim 4, wherein a width of the immediate-release actuator is at least as large as half of a width of the housing.

7. The switching device in accordance with claim 3, wherein the immediate-release actuator comprises a coil with a round cross-section.

8. The switching device in accordance with claim 5, wherein the immediate-release actuator comprises a coil with a round cross-section.

9. The switching device in accordance with claim 1, wherein at least one housing area contains a delayed-release actuator.

10. The switching device in accordance with claim 2, wherein at least one housing area contains a delayed-release actuator.

11. The switching device in accordance with claim 3, wherein at least one housing area contains a delayed-release actuator.

12. The switching device in accordance with claim 5, wherein at least one housing area contains a delayed-release actuator.

13. The switching device in accordance with claim 7, wherein at least one housing area contains a delayed-release actuator.

14. The switching device in accordance with claim 1, wherein the housing comprises more than two housing areas.

15. The switching device in accordance with claim 2, wherein the housing comprises more than two housing areas.

16. The switching device in accordance with claim 3, wherein the housing comprises more than two housing areas.

17. The switching device in accordance with claim 1, wherein the housing areas contain different circuit arrangements.

18. The switching device in accordance with claim 2, wherein the housing areas contain dilThrent circuit arrangements.

19. The switching device in accordance with claim 3, wherein the housing areas contain different circuit arrangements.

* * * * *